US007670197B2

(12) United States Patent
Janulis et al.

(10) Patent No.: US 7,670,197 B2
(45) Date of Patent: Mar. 2, 2010

(54) ELECTRICAL SPLICE CONNECTOR

(75) Inventors: Eugene P. Janulis, Austin, TX (US); David V. Mahoney, Austin, TX (US); Garry L. Sjolander, Pflugerville, TX (US); Richard D. Twigg, Leander, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 77 days.

(21) Appl. No.: 11/961,361

(22) Filed: Dec. 20, 2007

(65) Prior Publication Data

US 2009/0163086 A1 Jun. 25, 2009

(51) Int. Cl.
*H01R 11/09* (2006.01)

(52) U.S. Cl. ..... 439/787; 439/441

(58) Field of Classification Search ..... 439/787, 439/786, 436–441

See application file for complete search history.

(56) References Cited

U.S. PATENT DOCUMENTS 4,759,725 A 7/1988 Finch
4,768,976 A * 9/1988 Gelati ..... 439/441
4,832,615 A 5/1989 Thakrar et al.
5,149,279 A 9/1992 Kruse
5,266,045 A 11/1993 Yamamoto et al.
5,393,932 A 2/1995 Young et al.
5,454,730 A * 10/1995 Tozuka ..... 439/438
5,651,695 A 7/1997 Lee et al.
5,720,629 A 2/1998 Self, Jr. et al.
5,937,119 A 8/1999 Harting et al.
6,062,919 A * 5/2000 Trafton ..... 439/843
6,093,052 A * 7/2000 Wang ..... 439/441
6,428,343 B1 8/2002 Landis et al.
6,746,286 B2 6/2004 Blaha
6,872,096 B2 * 3/2005 Baker ..... 439/654
7,025,621 B2 4/2006 Mossner et al.
7,090,544 B2 8/2006 Campbell et al.
7,104,832 B2 9/2006 Campbell et al.
7,255,592 B1 8/2007 Tseng
7,281,942 B2 * 10/2007 Swedberg et al. ..... 439/441
2001/0010981 A1 8/2001 Cutler et al.
2005/0095901 A1 5/2005 Miller et al.
2005/0181681 A1 8/2005 Arai et al.

(Continued)

FOREIGN PATENT DOCUMENTS

DE 19530241 2/1997

(Continued)

OTHER PUBLICATIONS

Office Action for U.S. App. No. 11/961,260, by Examiner Phuongchi T. Nguyen, dated Aug. 12, 2008.

(Continued)

*Primary Examiner*—Tho D Ta
*Assistant Examiner*—Travis Chambers
(74) *Attorney, Agent, or Firm*—Melanie G. Gover

(57) ABSTRACT

An electrical splice connector includes a housing, a conductive member retained within the housing and defining a longitudinal axis, and at least two biasing members circumferentially disposed about the longitudinal axis of the conductive member and biased toward the conductive member. Each of the biasing members is configured to urge conductors inserted into the housing into electrical contact with the conductive member.

27 Claims, 8 Drawing Sheets

U.S. PATENT DOCUMENTS

| | | | | |
|---|---|---|---|---|
| 2006/0110983 | A1 | 5/2006 | Muench et al. | |
| 2008/0207029 | A1 * | 8/2008 | Defibaugh et al. | 439/206 |

FOREIGN PATENT DOCUMENTS

| | | |
|---|---|---|
| DE | 199 25 782 | 12/2000 |
| DE | 19925782 | 12/2000 |
| EP | 0821458 | 1/1998 |
| GB | 2095925 | 10/1982 |

OTHER PUBLICATIONS

Office Action for U.S. App. No. 11/961,260, by Examiner Phuongchi T. Nguyen, dated Apr. 2, 2009.

* cited by examiner

ELECTRICAL SPLICE CONNECTOR

BACKGROUND

Electric cables are broadly employed in a variety of industries and applications, including applications in communications, telecommunications, automotive, and/or appliances. Some electrical cables distribute power across vast power grids or networks, moving electricity from power generation plants to the consumers of electrical power, and moving electricity from one power grid to another power grid. Other electrical cables are employed in wiring homes and/or businesses.

Electrical cables generally include a conductive core (typically copper or aluminum) and may include one or more layers of surrounding insulating material. Some power cables include multiple twisted conductive wires. Electrical cables are constructed to carry high voltages (greater than about 50,000 volts), medium voltages (between about 1,000 volts and about 50,000 volts), or low voltages (less than about a 1,000 volts).

It is sometimes desirable to periodically form a splice or a junction in the cable, for example to electrically connect two electrical devices or to distribute electricity to additional branches of a power grid. Such branches may be further distributed until the grid reaches individual homes, businesses, offices. As one example, a single power cable supplying electrical power to a group of several buildings is commonly branched to each of the buildings. As used in this specification, the terms "splice" and "junction" are used interchangeably, and in each case refer to the portion of an electrical system where an incoming cable is connected to at least one outgoing cable.

Connecting incoming cables with one or more outgoing cables can potentially result in heating the cables at the junction, or heating the electrical connector employed to form the junction. It is desirable to quickly and conveniently form the splice in a manner that is configured to minimize electrical heating of the cables.

For these and other reasons, there is a need for the present invention.

SUMMARY

Embodiments according to the invention provide an electrical splice connector. The electrical splice connector includes a housing, a conductive member retained within the housing and defining a longitudinal axis, and at least two biasing members circumferentially disposed about the longitudinal axis of the conductive member and biased toward the conductive member. Each of the biasing members is configured to urge conductors inserted into the housing into electrical contact with the conductive member.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

Embodiments provide an electrical splice connector including two or more biasing members that are configured to urge a conductor into electrical contact with a conductive member of the electrical splice connector. In one embodiment, the electrical splice connector includes a cylindrical housing disposed around a cylindrical conductive member that is in turn disposed around at least two biasing members that are each configured to bias conductors inserted into the housing into electrical contact with the conductive member.

The cylindrical housing and conductive member are configured to provide improved heat dissipation and minimize undesirable overheating of the connector spliced between two conductors.

Embodiments provide an electrical splice connector configured to electrically connect conductors/wires having a wide range of conductor sizes. In one embodiment, an electrical splice connector is provided that electrically connects conductors, such as wires in a residential dwelling, having a size ranging from 10 gauge solid to 18 gauge stranded wire. Other embodiments provide an electrical splice connector suited for electrically connecting telecom, automotive, or industrial-sized conductors.

Figure 1A:
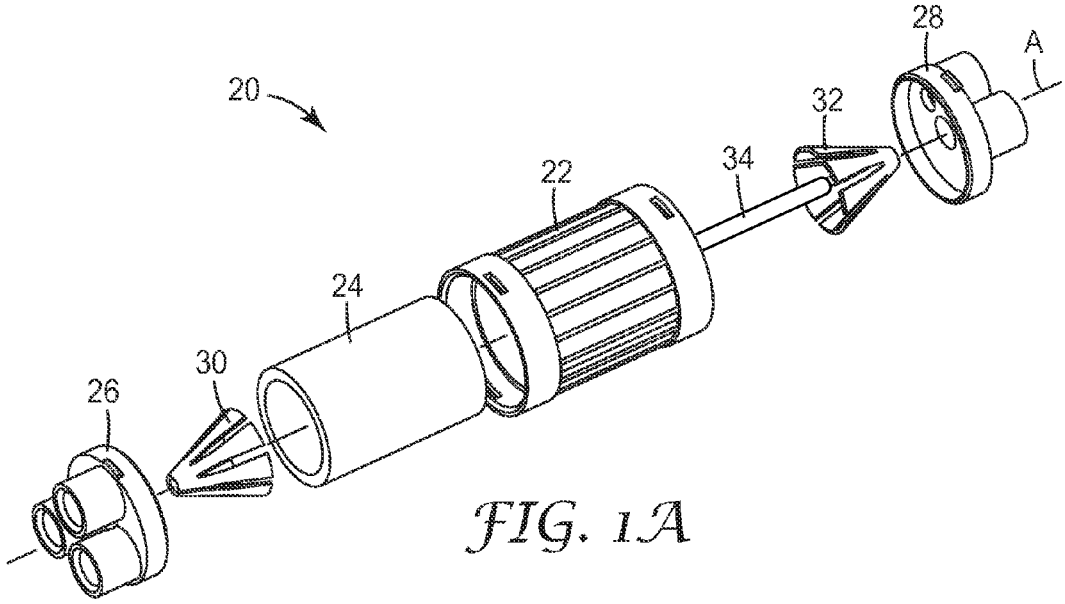
FIG. 1A is an exploded perspective view of an electrical splice connector according to one embodiment.
Figure 1B:
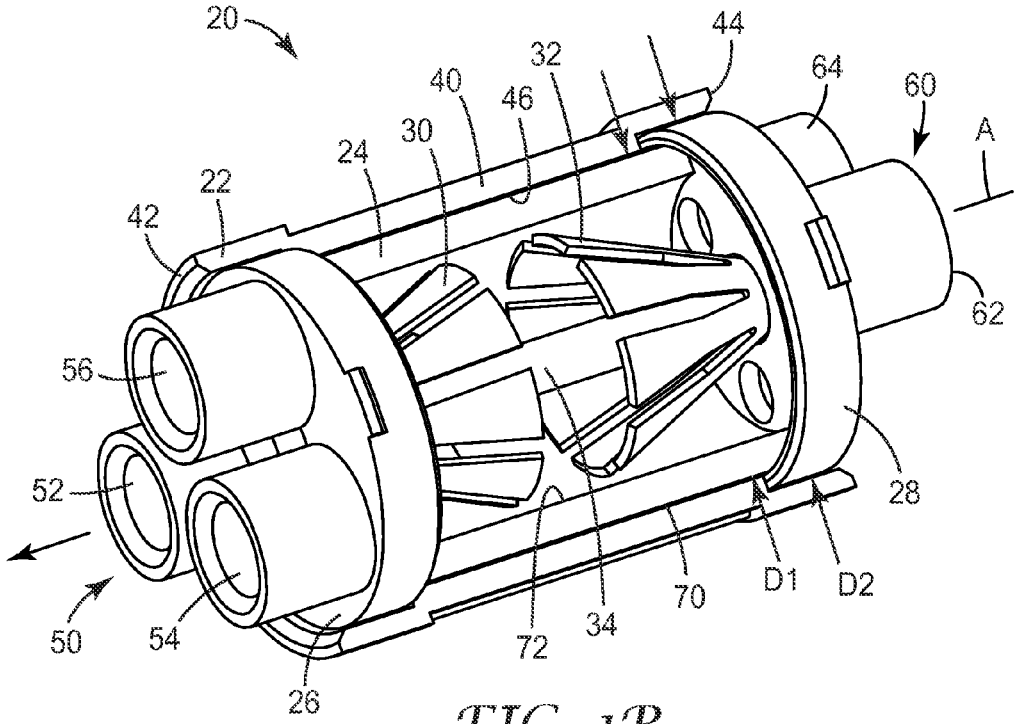
FIG. 1B is a sectional view of the electrical splice connector shown in FIG. 1A as assembled.

FIG. 1A is an exploded perspective view and FIG. 1B is an assembled section view of an electrical splice connector 20 according to one embodiment. Electrical splice connector 20 includes a housing 22, a conductive member 24 retained within housing 22, two biasing members 30, 32 circumferentially disposed within conductive member 24, and opposing end caps 26, 28. Conductive member 24 defines a longitudinal axis A. Biasing members 30, 32 are disposed about longitudinal axis A of conductive member 24 and are outwardly biased toward conductive member 24. Biasing members 30, 32 are configured to urge conductors (not shown) inserted into housing 22 into electrical contact with conductive member 24.

In one embodiment, conductive member 24 is retained within housing 22 between a first end cap 26 and an opposing end cap 28. In one embodiment, a rod 34 is provided that extends between end caps 26, 28 to support biasing members 30, 32 circumferentially within conductive member 24. In another embodiment, rod 34 is optional and biasing member 30 is coupled to end cap 26 and biasing member 32 is coupled to end cap 28.

In one embodiment, housing 22 includes a substantially cylindrical housing having a wall 40 extending between a first end 42 and an opposing second end 44, where wall 40 defines an interior surface 46. In one embodiment, housing 22 defines a central diameter D1 extending between opposing sides of interior surface 46 and a larger diameter D2 adjacent to each end 42, 44 configured to receive respective end caps 26, 28. In this manner, housing 22 defines a hollow housing that is flared at ends 42, 44 to step up from central diameter D1 to larger diameter D2 adjacent ends 42, 44.

In this specification, the term "cylindrical" means any body defined by a longitudinal axis and a wall that defines an exterior surface, and includes circular cylinders, non-circular cylinders, solid cylinders, and hollow cylinders. The peripheral shape of a cross-section of the wall thus includes circular shapes, non-circular shapes, polygonal shapes, and other geometric shapes. Thus, a cylindrical housing or member is not limited to housings or members having circular shapes in cross-section, and includes polygonal shapes that approximate a cylinder.

Suitable materials for housing 22 include plastics such as thermoplastics, thermoset plastics, curable plastics, molded plastics, and other suitable electrical non-conductive materials including non-plastic materials. In one embodiment, housing 22 is formed of polycarbonate and is translucent or transparent to enable optical viewing of electrical connections made within housing 22. Other suitable materials for forming housing 22 are also acceptable. In another embodiment, housing 22 is configured to provide high rates of heat transfer, which can be useful when connecting high voltage conductors. Suitable high heat transfer housings 22 include housings formed of a plastic filled with metal, such a polycarbonate filled with aluminum trihydroxide particles, or housings formed of a composition of a metal filled with plastic particles.

In one embodiment, conductive member 24 includes a substantially cylindrical conductive member disposed within housing 22. In one embodiment, substantially cylindrical conductive member 24 defines a hollow member having an exterior surface 70 that is disposed immediately adjacent to interior surface 46 of cylindrical wall 40 and an interior surface 72 opposite exterior surface 70. In one embodiment, conductive member 24 is press-fit within cylindrical housing 22. In another embodiment, conductive member 24 is disposed within housing 22 and retained in place by end caps 26, 28.

Suitable materials for conductive member 24 include electrically conductive materials, one example of which is metal. In one embodiment, conductive member 24 is fabricated from copper, alloys of copper, aluminum, alloys of aluminum, bronze, nickel, alloys of nickel, or other suitable electrically conducting materials including non-metallic conducting materials. In one embodiment, conductive member 24 is a substantially cylindrical member formed of brass including a tin plating.

End caps 26, 28 are generally formed of electrically non-conductive material and are configured to couple to one of the respective ends 42, 44 of housing 22. In one embodiment, end caps 26, 28 are configured to snap into a respective end 42, 44 of housing 22. In other embodiments, end caps 26, 28 are threaded, welded, glued, or friction-fit onto a respective end 42, 44 of housing 22.

In one embodiment, end cap 26 provides a plurality of openings 50 including a first opening 52, a second opening 54, and a third opening 56. Other suitable numbers for the plurality of openings 50 formed in end cap 26 are also acceptable such as one opening, two openings, or four or more openings. In one embodiment, end cap 28 defines a plurality of openings 60 including a first opening 62 and a second opening 64. Other numbers for the plurality of openings 60 of second end cap 28 are also acceptable, including one opening, three openings, or four or more openings.

In one embodiment, biasing member 30 is provided separately from biasing member 32. In another embodiment, biasing member 30 and biasing member 32 are attached by rod 34 and provided as an assembly. In one embodiment, biasing member 30 is a conical spring and is substantially identical to biasing member 32. In another embodiment, biasing member 30 is different from biasing member 32, for example, being formed of a different material, having different diameters, different leaf lengths, etc.

In this specification, the term "conical" includes cones, polygonal shapes that approximate a cone, multi-sided members that approximate a funnel-shape, members that approximate a bell-shape, and similar such shapes that are truncated by removing an apex of a conical shape, resulting in a frustum having a plane defined by the removed apex that is approximately parallel to a base of the conical shape.

In general, biasing members 30, 32 are configured to provide a biasing force outward in the direction of conductive member 24 (i.e., generally transverse to axis A) such that a conductor (not shown) inserted into one of the plurality of openings 50, 60 is forced into electrical contact with conductive member 24. In one embodiment, the inserted conductor has a size of between about 10-20 gauge and the biasing force of biasing members 30, 32 is configured to enable easy insertion of the conductor into housing 22 (e.g., insertion by hand) in combination with a relatively large pull-out force (e.g., about 15 pounds) selected to hold the conductor in electrical contact with conductive member 24. In one embodiment, the biasing force for biasing members 30, 32 is configured such that an inserted conductor cannot be removed from housing 22 without destructively breaking one or both of connector 20 or the inserted conductor.

Suitable materials for biasing members 30, 32 include metals and other electrically conductive materials. In one embodiment, biasing members 30, 32 are formed from spring steel, stainless steel, bronze, or copper into a substantially conical spring. In one embodiment, each biasing member 30, 32 is formed of heat treatable steel such as 410 stainless steel, although other metals, metal-coated plastics, or plastics are also acceptable depending upon the end-use application. Biasing members 30, 32 are suitably fabricated by die cutting, stamping, drawing, annealing, and/or punching.

Figure 2:
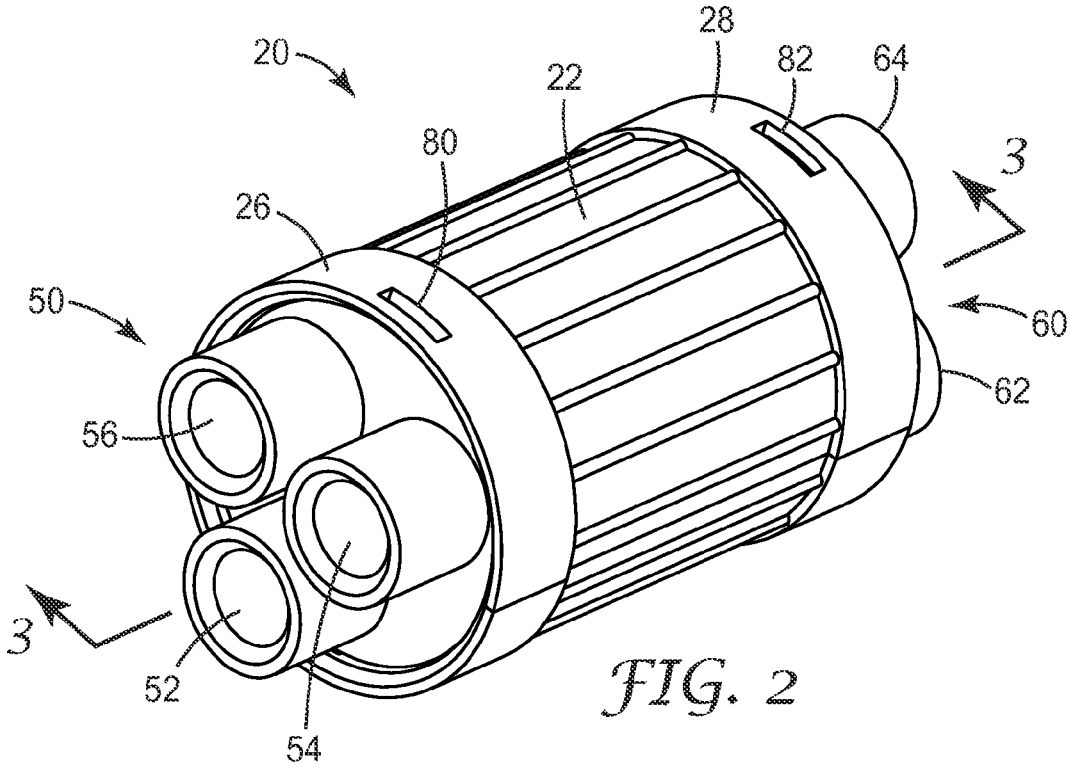
FIG. 2 is a perspective view of the electrical splice connector of FIG. 1A as assembled.

FIG. 2 is a perspective view of electrical splice connector 20 as assembled. In one embodiment, first end cap 26 defines projections 80 (one shown) that are configured to snap-fit into a corresponding slots provided by housing 22, and second end cap 28 defines projections 82 (one shown) configured to snap-fit into other corresponding slots provided by housing 22. The plurality of openings 50 formed by first end cap 26 and the plurality of openings 60 formed by second end cap 28 provide conductor receiver openings 52, 54, 56, and 62, 64, respectively, that communicate with an interior of housing 22.

Figure 3:
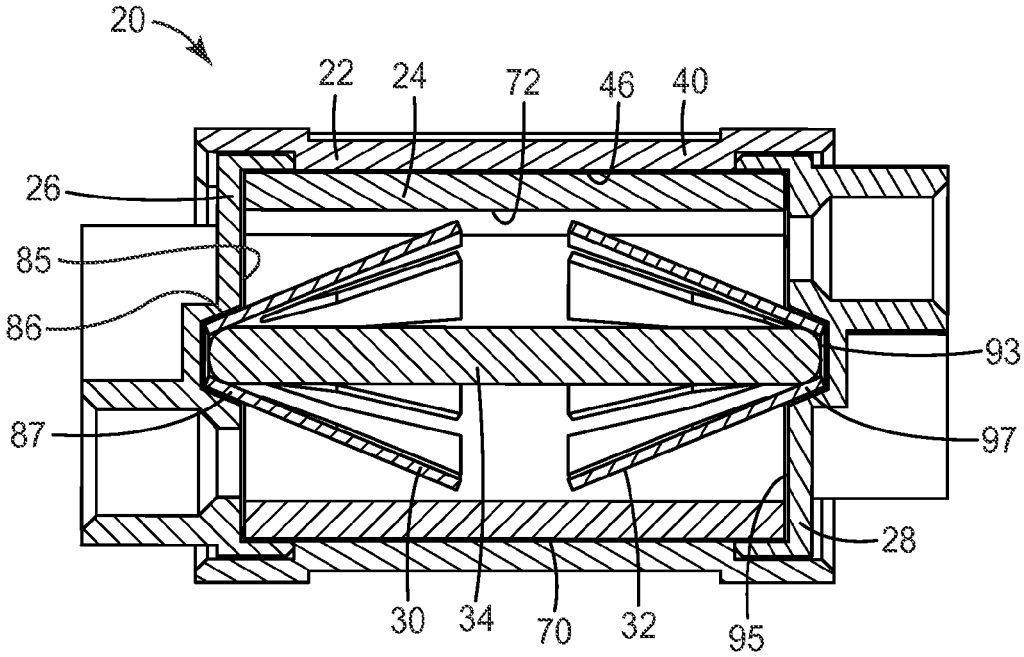
FIG. 3 is a cross-sectional view of the assembled electrical splice connector shown in FIG. 2.

FIG. 3 is a cross-sectional view of the assembled electrical splice connector 20. Conductive member 24 is inserted into housing 22 such that exterior surface 70 of conductive member 24 is substantially contiguous with interior surface 46 of housing 22. Placement of conductive member 24 against housing 22 configures electrical splice connector 20 for improved heat transfer. For example, in one embodiment housing 22 and conductive member 24 combine to effectively dissipate heat generated by the electrically connected conductors inserted into housing 22. Other embodiments provide conductive member 24 offset a distance from housing 22.

In general, biasing members 30, 32 are circumferentially disposed within conductive member 24. In one embodiment, an inner surface 85 of first end cap 26 defines a relief 86 sized to receive a small end 87 of conical biasing member 30, and an inner surface 95 of second end cap 28 defines a relief 93 sized to receive a small end 97 of conical biasing member 32. In one embodiment, rod 34 is a free-floating rod 34 that extends between first end cap 26 and second end cap 28 to maintain biasing member 30 against cap 26 and biasing member 32 against cap 28.

In another embodiment, biasing member 30 is coupled to one end of rod 34 and second biasing member 32 is coupled to an opposing end of rod 34, and rod 34 extends between end caps 26, 28 such that biasing member 30 is disposed adjacent to first end cap 26 and second biasing member 32 is disposed adjacent to second end cap 28. Other structures for circumferentially disposing biasing members 30, 32 within conductive member 24, and other relative locations for biasing members 30, 32 are also acceptable.

When electrical splice connector 20 is configured for larger gauge conductors (i.e., conductors having smaller diameters), biasing members 30, 32 are configured to expand outward to contact conductive member 24. When electrical splice connector 20 is configured for smaller gauge conductors (i.e., conductors having larger diameters), biasing members 30, 32 are configured to provide an offset space between biasing members 30, 32 and conductive member 24, where the offset space is selected to reduce the insertion force for the inserted conductors.

Figure 4A:
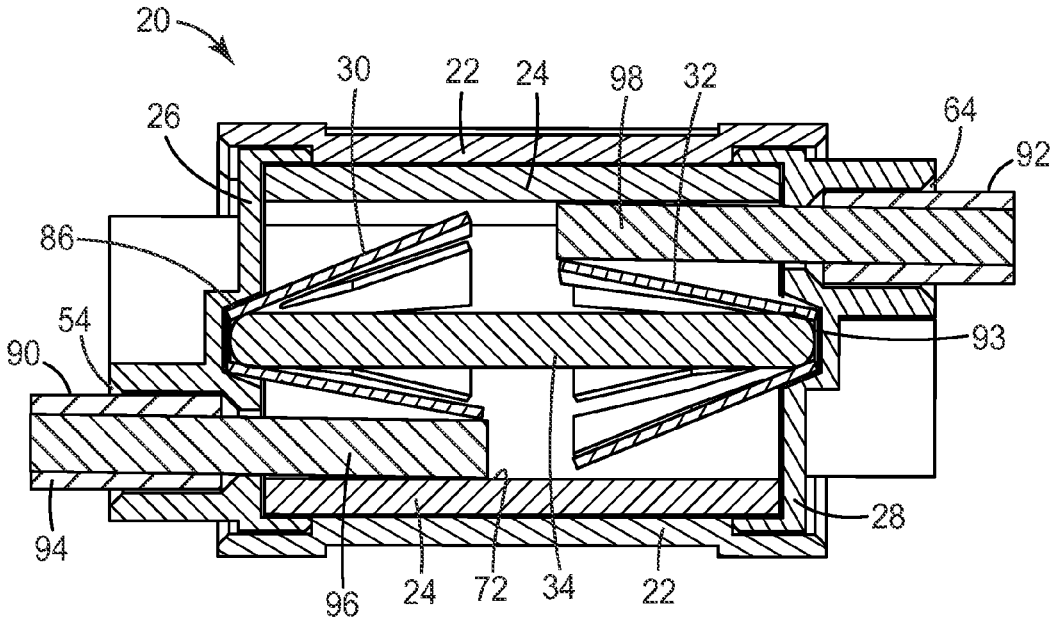
FIG. 4A is a cross-sectional view of the assembled electrical splice connector shown in FIG. 2 including a first conductor inserted into a first end of the splice connector and a second conductor inserted into a second end of the splice connector.

FIG. 4A is a cross-sectional view of electrical splice connector 20 including a first conductor 90 inserted into opening 54 and a second conductor 92 inserted into opening 64. In one embodiment, conductor 90 is an insulated conductor including insulation 94, a portion of which is removed to define a conductive end portion 96. Conductor 92 is similar to conductor 90 and includes a conductive end portion 98. In other embodiments, conductors 90, 92 do not include insulation.

Biasing members 30, 32 are configured to bias or otherwise deflect conductive end portions 96, 98, respectively, into electrical contact with conductive member 24. With additional reference to FIG. 2, in one embodiment conductor 90 is insertable into any one of the plurality of openings 50 defined by first end cap 26 and biasing member 30 is configured to bias conductive end portion 96 into electrical contact with interior surface 72 of conductive member 24. In a similar manner, conductor 92 is insertable into any one of plurality of openings 60 formed by second end cap 28 such that conductive end portion 98 is forced into electrical contact with interior surface 72 of conductor member 24.

In one embodiment, biasing members 30, 32 are configured to provide an outward biasing force that presses conductive end portions 96, 98 against conductive member 24 such that conductors 90, 92, respectively, cannot be removed from electrical splice connector 20 without deforming or destructing one or both of connectors 90/92 and/or electrical splice connector 20.

It is desirable that conductors 90, 92 are insertable into electrical splice connector 20 without undesirable twisting motions, which can potentially column buckle conductors 90, 92. In one embodiment, biasing members 30, 32 include segmented leaf springs that enable conductors 90, 92 to be directly (i.e., linearly) pushed inward into electrical splice connector 20 without undesired twisting of conductors 90, 92. In another embodiment, multiple biasing members are disposed on bilateral sides of electrical splice connector 20 as described below to achieve a desired force to bias connective end portions 96, 98 of small gauge conductors into electrical connection with conductive member 24.

Figure 4B:
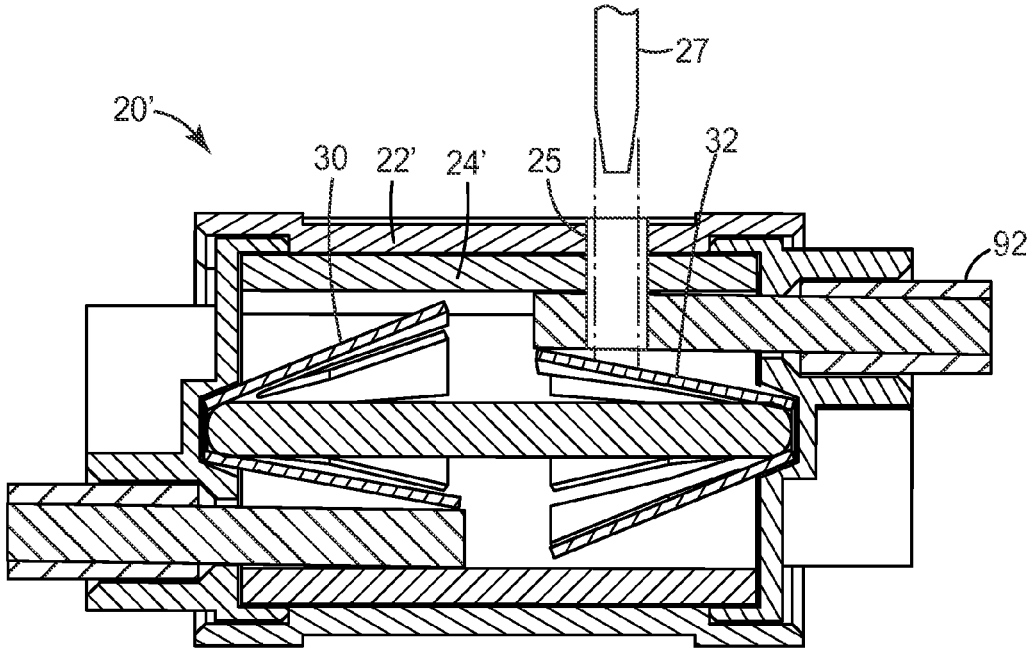
FIG. 4B is a cross-sectional view of another electrical connector including means for removing inserted conductor shown in FIG. 4A.

FIG. 4B is a cross-sectional view of an electrical connector 20' including means for removing inserted conductor 92. In one embodiment, housing 22' and conductive member 24' each define a slot 25 that combine to provide a passageway for a tool 27 to enter connector 20'. Tool 27 is configured to deflect biasing member 32, for example, thus relieving the biasing stress applied by biasing member 32 toward conductive member 24', to enable removal of conductor 92. For example, embodiments provide slot 25 sized to receive a flat-blade screwdriver or similar device that may be employed to displace biasing member 32 a distance sufficient to relieve the force that the biasing member 32 applies to conductor 92. In other embodiments, a passageway is provided in one or both end caps 26, 28 (FIG. 1A) to enable tool 27 to enter housing 22' parallel to inserted conductor 92 and relieve the biasing stress applied by biasing member 32 toward conductive member 24'.

Figure 5:
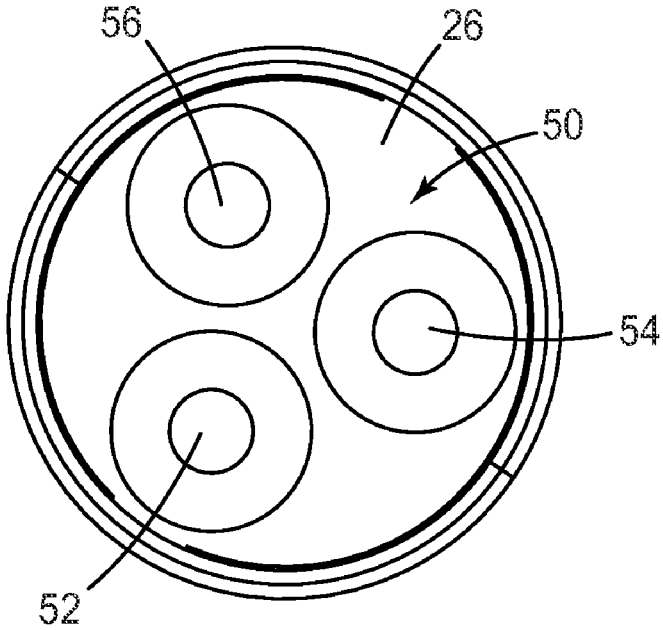
FIG. 5 is a front view of one end cap of the electrical splice connector shown in FIG. 1.
Figure 6:
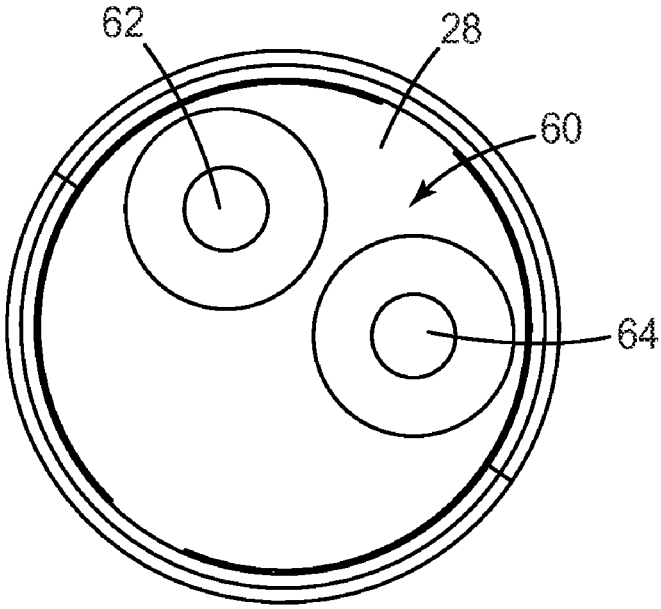
FIG. 6 is a front view of the other end cap of the electrical splice connector shown in FIG. 1.

FIG. 5 is a front view of first end cap 26 and FIG. 6 is a front view of second end cap 28. In one embodiment, first end cap 26 defines three conductor receiver openings 52, 54, 56 and second end cap 28 defines two conductor receiver openings 62, 64. In general, first and second end caps 26, 28 define at least one conductor receiver opening. The number of openings in each end cap 26, 28 can be the same or different depending upon an end use for electrical splice connector 20. In one embodiment, a plurality of end caps is provided, where each end cap has a different number of conductor receiver openings, and an installer or electrician selects a desired end cap to be releasably coupled to an end of housing 22 (FIG. 1). Each opening in the plurality of openings 50, 60 is configured to direct an inserted conductor into electrical contact with conductive member 24 (FIG. 1).

In one embodiment, a kit of parts is provided that includes electrical splice connector 20 and a plurality of end caps 26 and 28, where the plurality of end caps includes at least two end caps each defining at least one conductor receiver opening and at least one end cap 26, 28 defining at least two conductor receiver openings. The user can then select the end caps having the desired number of receiver openings for that particular installation application.

Figure 7A:
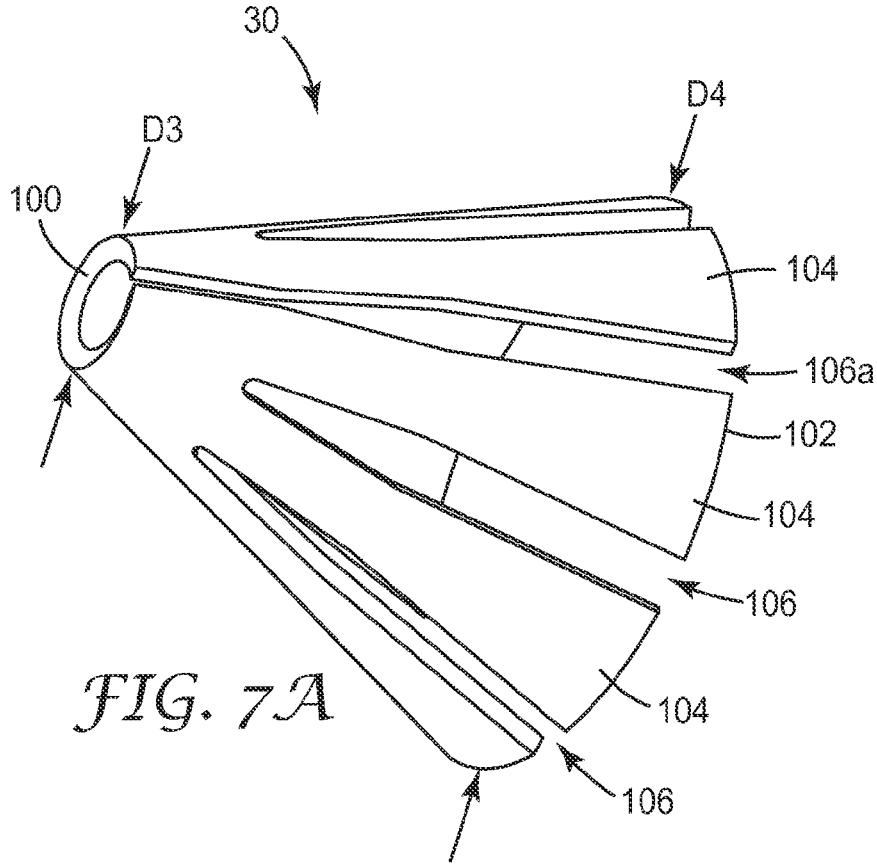
FIG. 7A is a perspective view of a spring member of the electrical splice connector shown in FIG. 1A according to one embodiment.

FIG. 7A is a perspective view of conical biasing member 30. In one embodiment, biasing member 32 (FIG. 1) is similar to biasing member 30 such that the following description applies equally to biasing member 32.

In one embodiment, biasing member 30 is funnel-shaped and includes a first end 100 that defines a first diameter D3 and a second end 102 that defines a second diameter D4 that is larger than first diameter D3. In one embodiment, biasing member 30 provides a conical spring having a plurality of segmented leafs 104 defined by relief slots 106 that extend from second end 102 toward first end 100. Leafs 104 are flexible and configured to bias in a radial direction such that biasing member 30 has attributes of a living spring. In one embodiment, one relief slot 106*a* extends an entire length between first end 100 and second end 102 to configure conical leaf spring 30 to flexibly accommodate a wide range of conductor sizes.

Figure 7B:
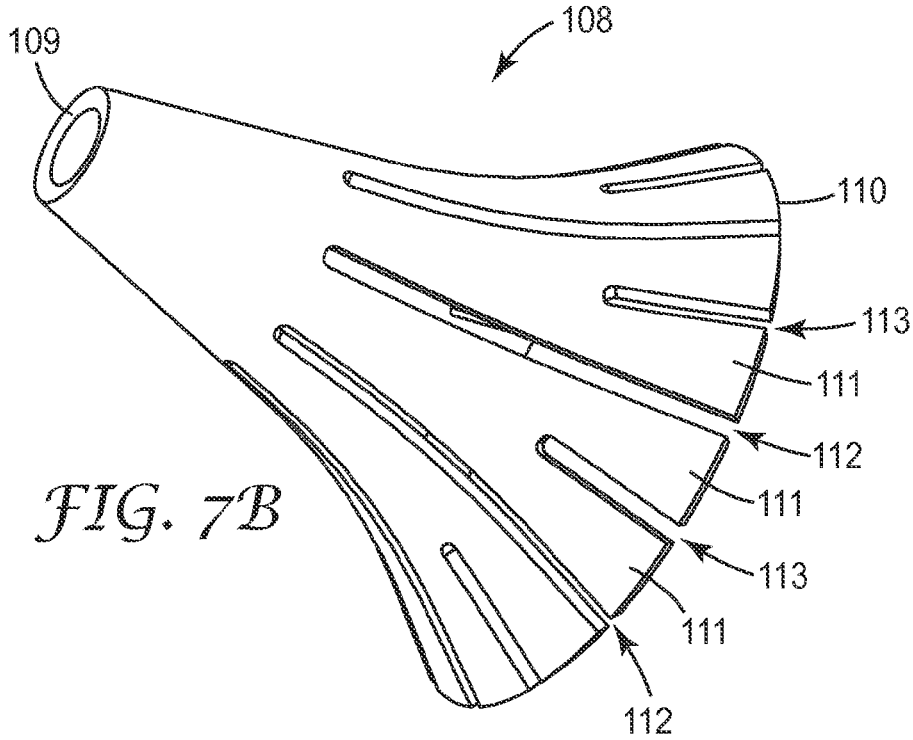
FIG. 7B is a perspective view of a bell-shaped biasing member according to another embodiment.

FIG. 7B is a perspective view of another form of a conical biasing member 108 according to one embodiment. In one embodiment, biasing member 108 is bell-shaped and includes a first end 109 that defines a first diameter and a second end 110 that defines a second diameter that is larger than first diameter. In one embodiment, biasing member 108 provides a conical spring having a plurality of segmented leafs 111 defined by relief slots 112 that extend from second end 110 toward first end 100. In one embodiment, leafs 111 include openings 113 configured to adjust a biasing force applied by leafs 111.

Figure 8:
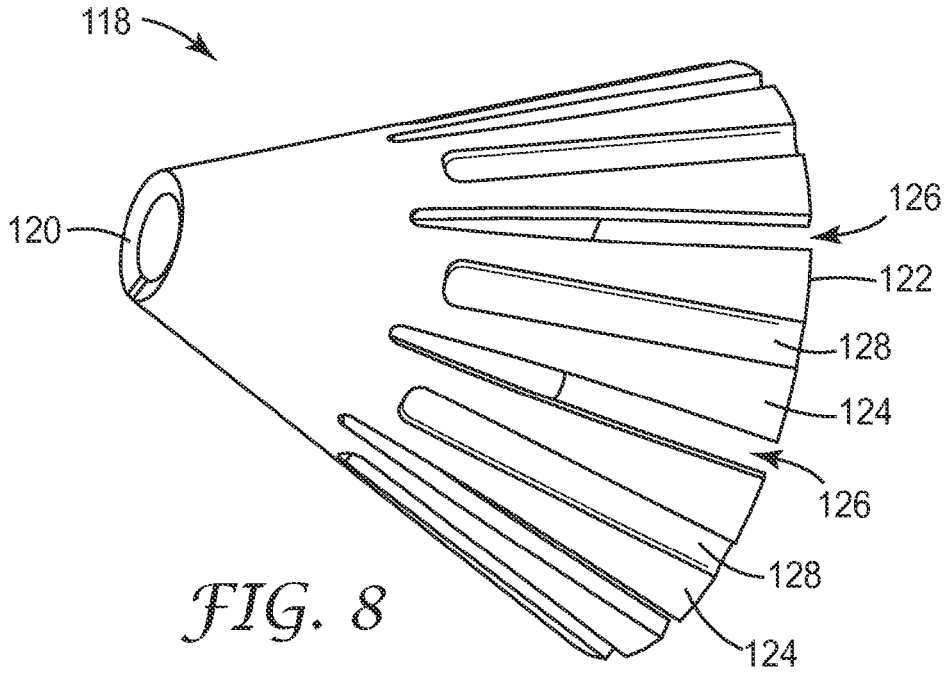
FIG. 8 is a perspective view of a spring member according to another embodiment.

FIG. 8 is a perspective view of a conical biasing member 118 according to another embodiment. Biasing member 118 includes a first end 120 and a second end 122, where second end 122 has a diameter that is larger than first end 120 such that biasing member 118 is funnel-shaped. Biasing member 118 includes segmented leafs 124 defined by relief slots 126 that extend from second end 122 toward first end 120.

In one embodiment, leafs 124 include a channel 128 formed between two relief slots 126. Channel 128 is configured to receive conductive end portion 96 (FIG. 4A) of conductor 90. In one embodiment, channel 128 is configured to enable biasing member 118 to guide/support smaller diameter (18-20 gauge) conductors, and in particular smaller diameter twisted wire conductors, enabling the smaller diameter conductors to be inserted into electrical splice connector 20 as described herein without undesirable buckling of the conductor 90.

Figure 9:
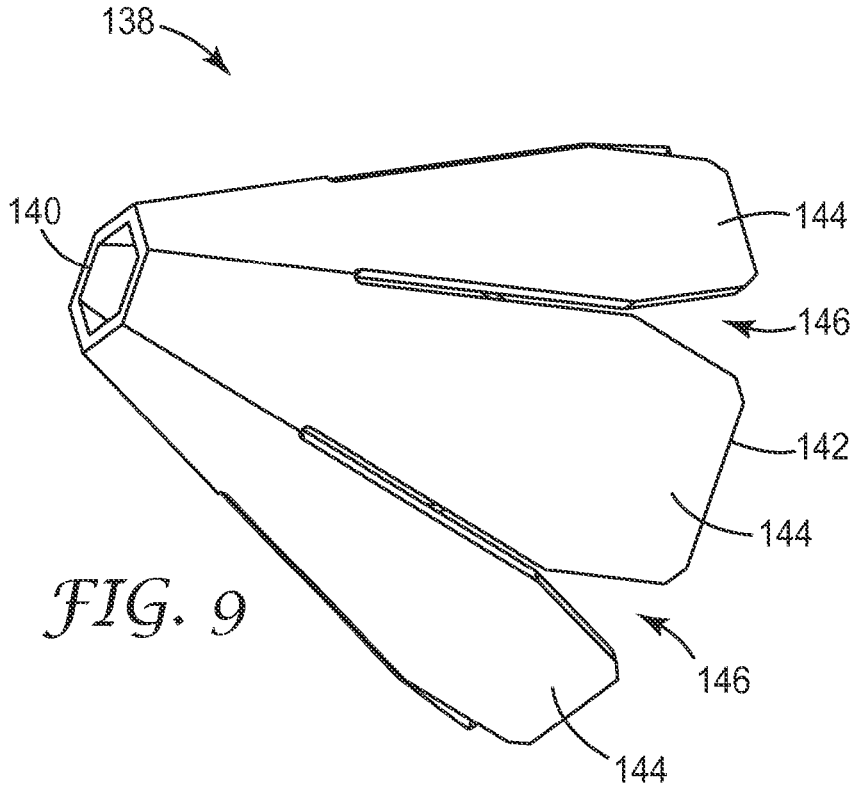
FIG. 9 is a perspective view of a spring member according to another embodiment.

FIG. 9 is a perspective view of a conical biasing member 138 according to another embodiment. Biasing member 138 includes a first end 140 and a second end 142 opposite first end 140. Biasing member 138 defines a conical spring member having a diameter at second end 142 that is larger than a diameter at first end 140. In one embodiment, biasing member 138 includes a plurality of leafs 144 defined by relief slots 146 that extend from second end 142 toward first end 140. In one embodiment, leafs 144 are polygonal in shape and are connected one to another along first end 140 such that conical biasing member 138 is non-circular in cross-section at first end 140 and second end 142.

Figure 10:
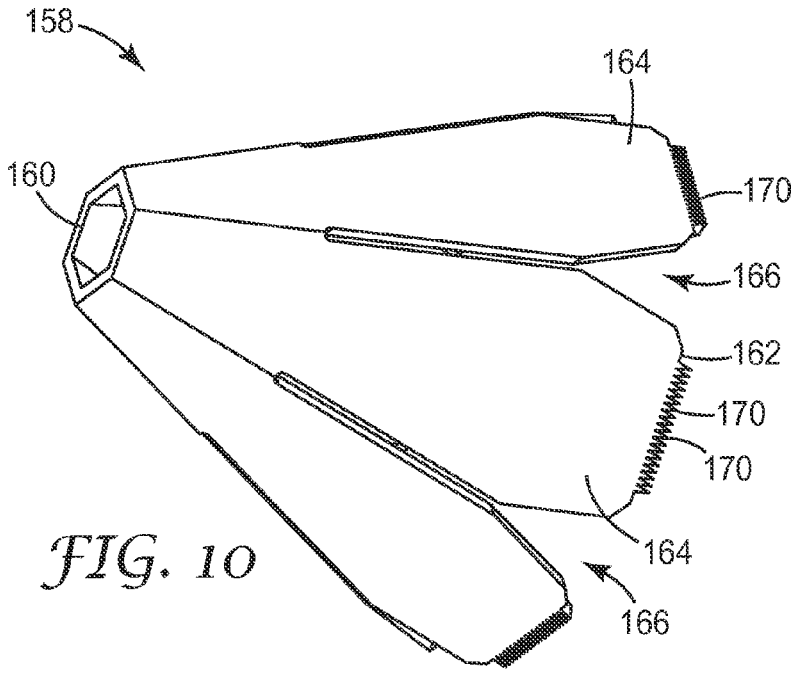
FIG. 10 is a perspective view of a spring member including teeth according to another embodiment.

FIG. 10 is a perspective view of a conical biasing member 158 according to another embodiment. Biasing member 158 includes a first end 160, a second end 162, and leafs 164 defined by relief slots 166 that extend from second end 162 toward first end 160. In one embodiment, leafs 164 include teeth 170 formed at second end 162. Teeth 170 are configured to engage with conductive end portion 96 of conductor 90 (FIG. 4A) to securely retain conductor 90 within electrical splice connector 20 (FIG. 4A). In one embodiment, teeth 170 are configured to remove, scratch through, or uncover oxidation formed on conductive end portion 96 to ensure electrical connection with conductive end portion 96.

With reference to FIG. 1, biasing member 30 includes any one of biasing members 32, 108, 118, 138, or 158 described herein, and biasing member 32 includes any one of biasing members 30, 108, 118, 138, or 158 described herein, where biasing member 30 is the same or different from biasing member 32.

Figure 11:
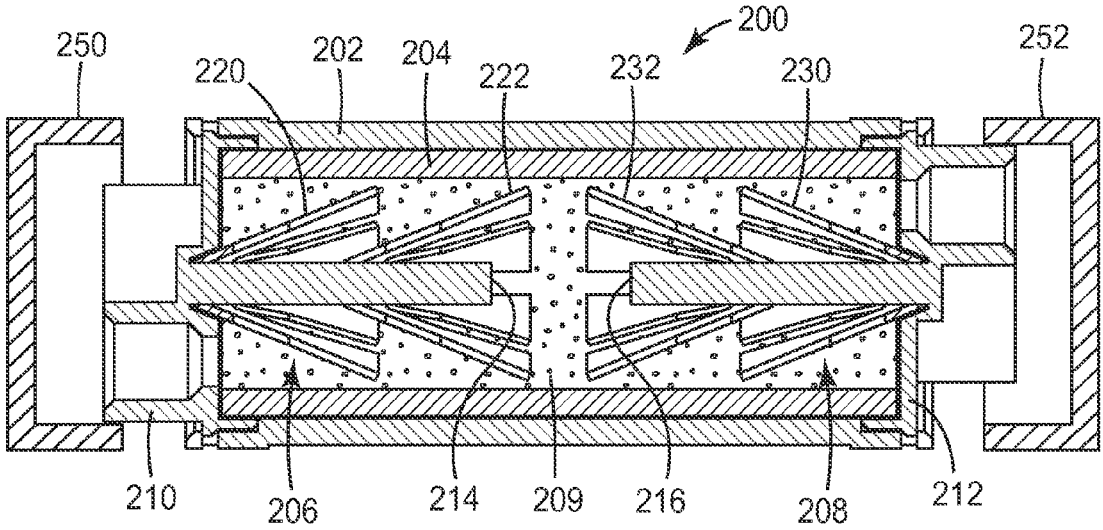
FIG. 11 is a cross-sectional view of an electrical splice connector according to another embodiment.

FIG. 11 is a cross-sectional view of an electrical splice connector 200 according to another embodiment. Electrical splice connector 200 includes a housing 202, a conductive member 204 retained within housing 202, a first pair 206 of biasing members disposed within conductive member 204, and a second pair 208 of biasing members disposed within conductive member 204 about a central longitudinal axis of conductive member 204. In one embodiment, an interior volume of conductive member 204 optionally includes sealant 209. Sealant 209 is configured prevent the ingress of moisture, dust, insects, or other debris into electrical splice connector 200. In one embodiment, sealant 209 is selected and configured to minimize or eliminate oxidation of metal portions of conductive member 204, first and second pairs 206, 208 of biasing members, and conductors/wires inserted into electrical splice connector 200.

In one embodiment, sealant 209 is a hydrophobic sealant, examples of which includes gel sealants or grease sealants. In general, gel sealant 209 includes soft rubbers and gels having shape memory. Gel sealant 209 is typically formed from at least one polymer in combination with at least one oil. The oil provides an extender for the gel sealant and includes hydrocarbon oil, such as naphthinic oils, paraffinic oils, aromatic oils, silicone oil, or vegetable ester oil, or a plasticizer such as phthalate ester oils. In one embodiment, gel sealant 209 includes multiple extenders and polymers, including extenders and polymers intermediate between oil and polymer. In one embodiment, gel sealant 209 includes a liquid rubber that is not part of the gel forming polymer network, such as polybutene of moderate molecular weight or a low molecular weight ethylene propylene rubber (EPR). These materials, in combination, are configured to tailor characteristics of the gel sealant 209 by increasing tack, for example.

The polymer-based gel can be either a thermoplastic or cured in place. The curing includes thermal curing, room temperature vulcanization, ultraviolet curing, e-beam curing, or other radiation initiated curing. It is desirable that the polymer be compatible with oil, and can include a rubber-like morphology, having flexible chains with molecular flexibility between cross-linking sites. Suitable polymers include polyurethanes, polyesters, polyepoxys, polyacrylates, polyolefins, polysiloxanes, polybutadienes (including polyisoprenes), hydrogenated polybutadienes and polyisoprenes, or block copolymers. The blocks of the block copolymers may include the above-identified polymers, and/or poly(monoalkenylarenes) including polystyrene. Suitable block copolymers include styrene-ethylene-butylene-styrene (SEBS), styrene-ethylene-propylene-styrene (SEPS), styrene-rubber-styrene polymers, di-block polymers, tri-block polymers, graft and star-block copolymers, or block copolymers with blocks that are non-homogeneous. Other suitable materials include closed-cell foamed materials, and materials incorporating micro-bubbles or soft (or hard) fillers.

Sealant 209 includes grease sealants. A grease is defined to be viscoelastic hydrophobic composition including 50-95% hydrocarbon oil, such as naphthinic oils or paraffinic oils and/or blends, aromatic oils, silicone oils, vegetable oils, or plasticizer oils such as phthalates. Greases are hydrophobic liquids at room temperature and include a low volatility such that they do not experience appreciable loss of mass after a long duration exposure to high operating temperatures. Some grease includes agents to provide the mechanical properties of low shear yield point and higher adhesion than cohesion. Desirable additives to grease include inorganic materials, including molybdenum sulfide, silica gels (including silica gels including a surface treatment control agglomeration) lithium compounds, soaps, waxes including polyethylene and polypropylene waxes, polymers including polyurethanes, polyesters, polyepoxys, polyacrylates, polyolefins, polysiloxanes, polybutadienes (including polyisoprenes), hydrogenated polybutadienes and polyisoprenes, or block copolymers. The blocks of the block copolymers may include the above identified polymers and poly(monoalkenylarenes) including polystyrene. Suitable block copolymers include SEB, SEP, SEBS, SEPS, Styrene-rubber polymers, di-block polymers, graft and star-block copolymers, or block copolymers with blocks that are non-homogeneous. In one embodiment, grease sealant 209 includes a grease sealant prepared from shearing a gel, as is disclosed in U.S. Pat. Nos. 5,292,058, 5,286,516, 5,418,001 or 5,601,668.

Conductive member 204 is retained within housing 202 between a first end cap 210 and an opposing second end cap 212. In one embodiment, first end cap 210 defines an end post 214 configured to support first pair 206 of biasing members, and second end cap 212 defines an end post 216 configured to support second pair 208 of biasing members.

In another embodiment, the biasing members are retained within conductive member 204 in which an inner surface of first end cap 210 defines a relief sized to receive a small end of one of the conical biasing members in pair 206, and an inner surface of second end cap 212 defines a relief sized to receive a small end of one of the conical biasing members in pair 208, in a manner similar to FIG. 3. In one embodiment, posts 214, 216 are formed as a single post that extends continuously and free-floats between first end cap 210 and second end cap 212 to retain the pairs 206, 208 of biasing members.

First pair 206 of biasing members includes a first biasing member 220 and a second biasing member 222, where biasing members 220, 222 individually include any of biasing members 30, 108, 118, 138, or 158 described herein. Second pair 208 of biasing members includes a first biasing member 230 and a second biasing member 232, where biasing members 230, 232 individually include any of biasing members 30, 108, 118, 138, or 158 described herein.

In one embodiment, housing 202 is similar to housing 22 described above and includes a plastic or other non-electrically conductive housing, and conductive member 204 is similar to conductive member 24 described above and is formed of a suitable electrically conducting material. Conical biasing members 220, 222 and 230, 232 are biased toward conductive member 204 and are configured to urge conductors (not shown) inserted into housing 202 into electrical contact with conductive member 204.

The multiple conical biasing members provided by first and second pairs 206, 208 of biasing members are configured to provide a sufficiently high outward radial force against inserted conductors (not shown) such that the inserted conductors (even large diameter conductors of about 10 gauge) cannot be removed from housing 202 without applying a pulling force to the conductors of greater than about 15 pounds. In some embodiments, more than two biasing members are employed adjacent to each end cap 210, 212 side to selectively vary the level of conductor removal force.

In one embodiment, an optional boots 250 and/or 252 are provided. Boot 250 is configured to seal end cap 210, and boot 252 is configured to seal end cap 212. Boots 250, 252 each include openings that correspond to openings provided in end caps 210, 212. In one embodiment, each boot 250, 252 is formed of a thermoplastic elastomer and includes "self-sealing" openings that are configured to close to limit entry of dust and debris into housing 202 and configured to seal over a conductor inserted into end caps 210, 212.

In one embodiment, boots 250, 252 are configured to constrain and/or retain sealant (209 in FIG. 11) provided on an interior (e.g., within) boots 250, 252. For example, in one embodiment no sealant is provided within housing 202 (FIG. 11), but sealant (not shown) is provided under one or both boots 250, 252. Boots 250, 252 are provided to constrain sealant, provide additional sealant to connector 200, or provide an entirety of sealant for connector 200. In one embodiment, when an inserted conductor is removed from housing 202, openings in boots 250, 252 are configured to skive or remove the sealant from the conductor.

Figure 12A:
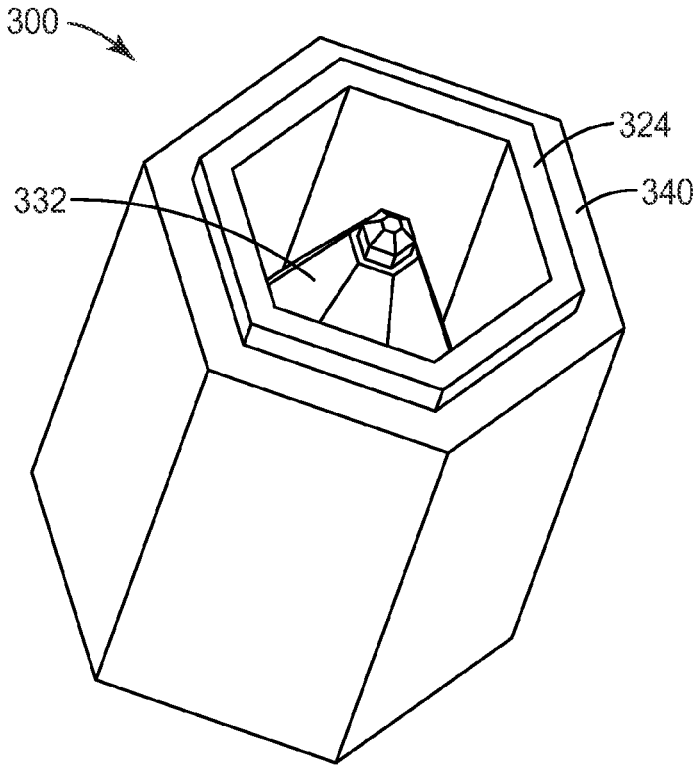
FIG. 12A is a perspective view of an electrical connector according to another embodiment.
Figure 12B:
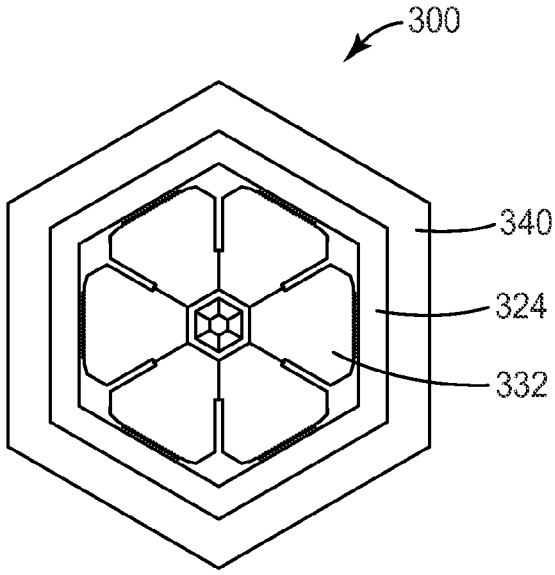
FIG. 12B is an end view of the electrical connector shown in FIG. 12A.

FIG. 12A is a perspective view of a multi-sided cylindrical electrical connector 300 according to another embodiment and FIG. 12B is an end view of electrical connector 300. Electrical connector 300 includes a housing 340, a conductive member 324 retained within housing 340, and at least two biasing members (one biasing member 332 is shown) circumferentially disposed within the conductive member 324. Biasing member 332 is configured to urge a conductor inserted into housing 340 into electrical contact with conductive member 324.

In one embodiment, housing 340 provides an electrically insulative cylindrical housing having a plurality of sides and conductive member 324 provides a cylindrical conductive member 324 having a plurality of sides retained within the cylindrical housing 340. In one embodiment, biasing member 332 is retained within cylindrical conductive member 324 along with one or more additional biasing members as shown above in FIG. 1B. Although not required, in one embodiment biasing member 332 includes a plurality of sides selected to correspond with the number of sides of cylindrical conductive member 324. Other geometrical shapes of cylindrical housing 340, cylindrical conductive member 324, and conical biasing member 332 are also acceptable.

Housing 340 is suitably formed of the materials described above for housing 40 (FIG. 1A), conductive member 324 is suitably formed of the materials described above for conductive member 24, and biasing member 332 includes the biasing members described above in FIGS. 7A-10.

An electrical splice connector is provided having a conductive member and two or more biasing members that are configured to urge an inserted conductor into electrical contact with the conductive member. One embodiment of the electrical splice connector includes a cylindrical housing enclosing a cylindrical conductive member that combine to provide improved heat dissipation for the splice connector.

Other embodiments provide conical biasing members that bias conductors inserted into the housing into electrical contact with a shared conductive member while minimizing or eliminating column buckling of the inserted conductor.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of an electrical splice connector as discussed herein. Therefore, it is intended that this invention be limited only by the claims and the equivalents thereof.

What is claimed is:

1. An electrical splice connector comprising:

a housing;

a conductive member retained within the housing and defining a longitudinal axis; and at least two biasing members, each biasing member circumferentially disposed about the longitudinal axis of the conductive member and biased toward the conductive member, the biasing members configured to urge conductors inserted into the housing into electrical contact with the conductive member, wherein the housing comprises a substantially cylindrical housing axially aligned with the longitudinal axis of the conductive member and the conductive member comprises a substantially cylindrical conductive member disposed contiguous with an interior surface of the substantially cylindrical housing.

2. The electrical splice connector of claim 1, wherein the housing comprises a plastic material filled with a thermally conductive material.

3. The electrical splice connector of claim 1, further comprising:

first and second end caps, each end cap coupled to respective first and second ends of the housing and defining a plurality of openings, each opening configured to receive an end of one of the conductors inserted into the housing.

4. The electrical splice connector of claim 3, wherein at least one of the biasing members comprises a conical spring member having a first end that defines a first diameter and a second end that defines a second diameter larger than the first diameter, the first end of the conical spring member disposed nearer to one of the first and second end caps than the second end of the conical spring member.

5. The electrical splice connector of claim 3, further comprising:

at least one boot configured to seal one of the first and second end caps, the boot configured to provide selective access to each of the plurality of openings formed in the end cap.

6. The electrical splice connector of claim 3, wherein each biasing member is circumferentially disposed within the conductive member and biased radially outward toward the conductive member, and further wherein at least an interior of the conductive member is filled with a sealant that is configured to minimize oxidation of each biasing member and the conductive member.

7. The electrical splice connector of claim 3, wherein at least one of the first and second end caps comprises an optically transparent end cap.

8. The electrical splice connector of claim 1, further comprising:

means for biasing one of the biasing members away from a surface of the conductive member to enable removal of the conductors inserted into the cylindrical housing.

9. The electrical splice connector of claim 8, wherein the housing and the conductive member retained within the housing each define a passageway communicating with at least one of the biasing members, the passageway sized to receive a tool configured to deflect at least one of the biasing members.

10. An electrical splice connector comprising:

a housing defining opposing first and second ends, each of the first and second ends defining at least one opening configured to receive an end of a conductor;

a substantially cylindrical electrically conductive member disposed within the housing;

a first biasing member disposed within the housing and configured to urge a first conductor inserted through a first opening in the first end of the housing into electrical contact with the substantially cylindrical electrically conductive member; and a second biasing member disposed within the housing and configured to urge a second conductor inserted through a first opening in the second end of the housing into electrical contact with the substantially cylindrical electrically conductive member, wherein first and second end caps are coupled to respective first and second ends of the housing, each end cap defining at least one conductor receiver opening extending into an interior of the housing, wherein the first and second biasing members comprise, respectively:

a first electrically conductive biasing member disposed within the substantially cylindrical electrically conductive member adjacent to the first end cap; and a second electrically conductive biasing member disposed within the substantially cylindrical electrically conductive member adjacent to the second end cap, and wherein the first and second electrically conductive biasing members comprise conical biasing members, each conical biasing member having a first end that defines a first diameter and a second end that defines a second diameter that is larger than the first diameter, and further wherein an inner surface of the first and second end caps each define a relief sized to receive the first end of a respective one of the conical biasing members.

11. The electrical splice connector of claim 10, wherein the housing comprises a substantially cylindrical housing.

12. The electrical splice connector of claim 10, wherein one of the first and second end caps defines at least two conductor receiver openings extending into an interior of the housing.

13. The electrical splice connector of claim 10, further comprising:

a retaining member extending along a central axis of the substantially cylindrical electrically conductive member between the first end cap and the second end cap, the retaining member configured to retain the first ends of the conical biasing members within the relief formed in the first and second end caps, respectively.

14. The electrical splice connector of claim 10, wherein the first and second end caps each comprise an end cap post extending centrally from an inner surface of the end cap, the first and second biasing members coupled to a respective one of the end cap posts.

15. The electrical splice connector of claim 10, wherein the first and second biasing members each comprise a polygonal spring having a first end, a second end, and a plurality of walls extending from the first end to the second end to define a generally conical shape.

16. The electrical splice connector of claim 10, wherein the first and second biasing members each comprise a pair of nested conical springs, each conical spring having a first end that defines a first diameter and a second end that defines a second diameter that is larger than the first diameter, the second ends disposed farther from the end caps than the first ends.

17. The electrical splice connector of claim 10, wherein the first and second end caps are configured to be releasably secured to respective first and second ends of the housing.

18. The electrical splice connector of claim 17, further comprising:

a kit of parts including the electrical splice connector and a plurality of end caps, the plurality of end caps including at least two end caps each defining at least one conductor receiver opening and at least one end cap defining at least two conductor receiver openings.

19. The electrical splice connector of claim 10, wherein the first and second biasing members each comprise a conical spring having a first end that defines a first diameter and a second end that defines a second diameter that is larger than the first diameter, the first ends of the first and second biasing members coupled to the first end cap and the second end cap, respectively.

20. The electrical splice connector of claim 19, wherein the second end of at least one of the conical springs comprises a plurality of teeth.

21. The electrical splice connector of claim 19, wherein at least one of the conical springs defines at least two relief slots extending from the second end toward the first end.

22. The electrical splice connector of claim 21, wherein at least one of the conical springs defines a channel between the at least two relief slots, the channel configured to receive the end of the conductor.

23. A method of splicing two or more electrical conductors, the method comprising:

providing at least two electrical conductors, each conductor having a conductive end portion;

inserting the conductive end portion of a first conductor into an opening formed on a first end of a connector housing;

inserting the conductive end portion of a second conductor into an opening formed on a second end of the connector housing; and electrically coupling the at least two electrical conductors by biasing the first and second conductive end portions into contact with an electrically conductive cylindrical insert disposed within the connector housing, wherein biasing the first and second conductive end portions into contact with an electrically conductive insert disposed within the connector housing comprises radially forcing the conductive end portion of the first conductor against the electrically conductive cylindrical insert with a first spring and radially forcing the conductive end portion of the second conductor against the electrically conductive cylindrical insert with a second spring different from the first spring.

24. The method of claim 23, wherein radially forcing the conductive end portions of the first and second conductors against the electrically conductive insert comprises impeding the removal of the first and second conductor end portions from the connector housing.

25. An electrical splice connector comprising:

a housing including an inner wall extending between a first open end and an opposing second open end;

an electrically conductive insert disposed within the housing, the conductive insert including an interior surface and an exterior surface that is adjacent to the inner wall of the housing;

a first biasing member disposed within the housing;

a second biasing member disposed within the housing;

a first cap coupled to the first open end of the housing, the first cap defining at least one opening configured to receive an end of a first conductor; and a second cap coupled to the second open end of the housing, the second cap defining a plurality of openings each configured to receive an end of a second conductor;

wherein the end of the first conductor is maintained in electrical contact with the interior surface of the electrically conductive insert by the first biasing member and the end of the second conductor is maintained in electrical contact with the interior surface of the electrically conductive insert by the second biasing member, wherein the first biasing member comprises a metal spring disposed adjacent to the interior surface of the substantially cylindrical electrically conductive insert and adjacent to the first cap, and the second biasing member comprises a second metal spring disposed adjacent to the substantially cylindrical electrically conductive insert and adjacent to the second cap.

26. The electrical splice connector of claim 25, wherein the housing comprises a substantially cylindrical housing.

27. The electrical splice connector of claim 26, wherein the electrically conductive insert comprises a substantially cylindrical electrically conductive insert nested within the substantially cylindrical housing.

* * * * *

UNITED STATES PATENT AND TRADEMARK OFFICE

CERTIFICATE OF CORRECTION

PATENT NO. : 7,670,197 B2
APPLICATION NO. : 11/961361
DATED : March 2, 2010
INVENTOR(S) : Eugene P. Janulis, Jr.

It is certified that error appears in the above-identified patent and that said Letters Patent is hereby corrected as shown below:

Column 8
Line 44, delete "naphthinic" and insert -- naphthenic -- therefore.

Column 9
Line 10, delete "naphthinic" and insert -- naphthenic -- therefore.

Signed and Sealed this

First Day of June, 2010

David J. Kappos

David J. Kappos
*Director of the United States Patent and Trademark Office*